United States Patent [19]

Badouard et al.

[11] Patent Number: 4,673,085

[45] Date of Patent: Jun. 16, 1987

[54] PACKAGE WITH PEEL-OFF FILM CLOSURE

[75] Inventors: Michel Badouard, Barentin; Claude Durame, Montville; Bernard Pade, Totes, all of France

[73] Assignee: Legrand, Limoges, France

[21] Appl. No.: 813,671

[22] Filed: Dec. 26, 1985

[30] Foreign Application Priority Data

Dec. 27, 1984 [FR] France ..... 84 19876

[51] Int. Cl.[4] ..... B65D 85/24; B65D 83/02

[52] U.S. Cl. ..... 206/459; 206/469; 206/631; 206/461

[58] Field of Search ..... 206/467, 469, 631, 629, 206/461, 338

[56] References Cited

U.S. PATENT DOCUMENTS

| | | | |
|---|---|---|---|
| 2,185,604 | 1/1940 | Moore | 206/631 |
| 3,154,225 | 10/1964 | Wadlinger et al. | 206/631 |
| 3,202,272 | 8/1965 | Hertzog | 206/461 |
| 3,325,000 | 6/1967 | Edwards | 206/564 |
| 3,670,927 | 6/1972 | Hubbard | 206/629 |
| 3,941,248 | 3/1976 | Moser et al. | 206/531 |
| 4,000,816 | 1/1977 | Spruyt | 206/631 |
| 4,236,637 | 12/1980 | Castner, Sr. et al. | 206/467 |
| 4,313,539 | 2/1982 | Raines | 206/461 |
| 4,444,310 | 4/1984 | Odell | 206/539 |
| 4,519,501 | 5/1985 | Cerwin | 206/339 |

FOREIGN PATENT DOCUMENTS

| | | |
|---|---|---|
| 1580772 | 7/1969 | France . |
| 2245203 | 4/1975 | France . |
| 2409916 | 6/1979 | France . |
| 1243535 | 8/1971 | United Kingdom . |

*Primary Examiner*—William Price
*Assistant Examiner*—Brenda J. Ehrhardt
*Attorney, Agent, or Firm*—Charles E. Brown; Charles A. Brown

[57] ABSTRACT

A package suitable for packaging elongate articles such as binding ties comprises a boat-shaped body having one open side. It has an outwardly projecting rim on the open side. A peel-off film closing the open side is attached to the rim. There is at least one reference mark, a notch for example, in the rim and the film enabling the package to be partially opened.

19 Claims, 7 Drawing Figures

FIG. 1
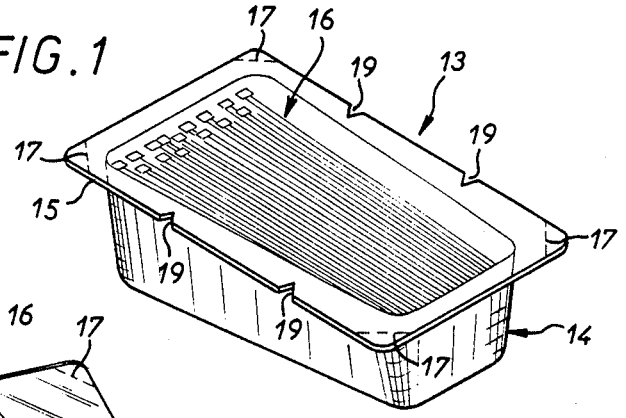
FIG. 2
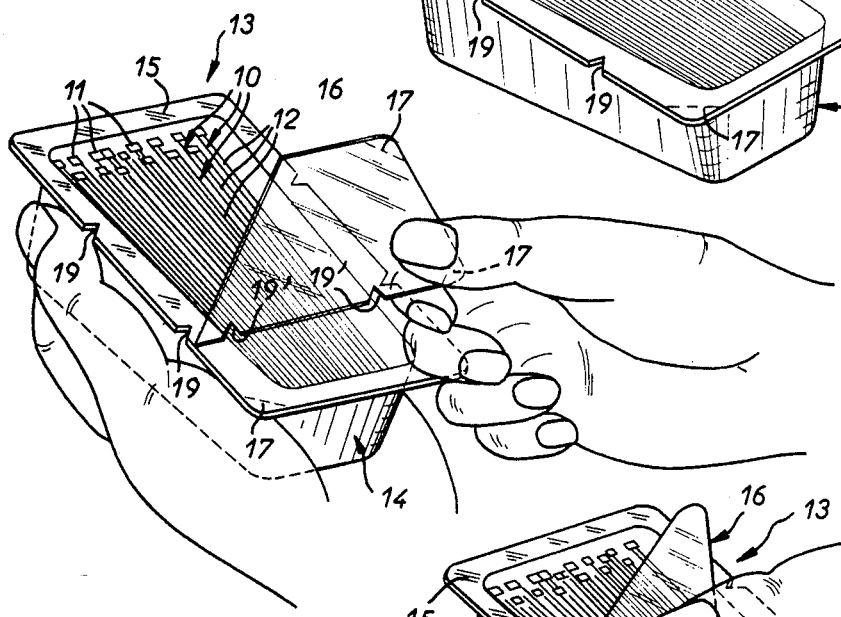
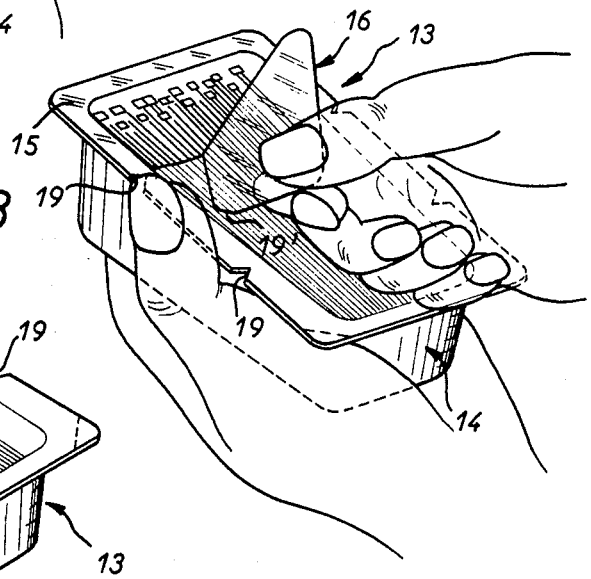
FIG. 3
FIG. 4
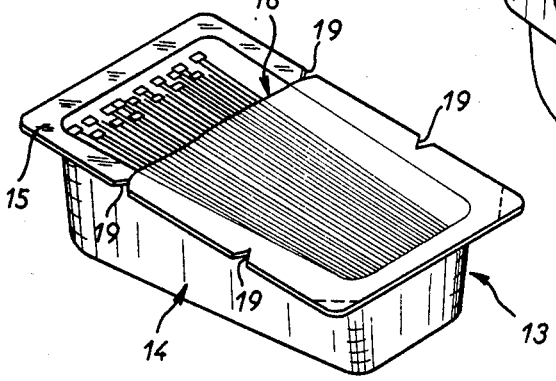
FIG. 5
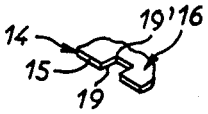
FIG. 6
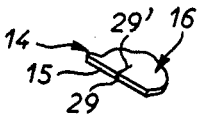
FIG. 7
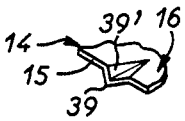

PACKAGE WITH PEEL-OFF FILM CLOSURE

BACKGROUND OF THE INVENTION

1. Field of the Invention

The present invention is generally concerned with packaging groups of sundry articles and in particular elongate particles such as binding ties, and is more particularly directed to the case where the package used comprises a boat-shaped body having one open side, an outwardly projecting rim on the open side and a peel-off film closing the open side attached to the rim, in practice by its periphery.

2. Description of the Prior Art

In order to open a package of this kind and thus to gain access to its contents, it is sufficient to exert sufficient traction on the peel-off film, more specifically on a corner or tab thereof left free for this purpose, to peel it off.

At present the package is usually opened completely, by removal of the peel-off film.

This is specifically the case when the entire peel-off film is removed.

It is also the case, however, when, as described in French Pat. No. 1 580 772, the peel-off film has a plurality of tabs or lugs disposed side by side and each corresponding to a strip; this is to facilitate removal of the peel-off film, the objective remaining complete removal of the peel-off film.

As a result of such complete removal of the peel-off film the body of the package is then wide open so that it is not possible to close it, even partially, unless a specific accessory device is used.

Although an arrangement of this kind is strictly satisfactory for packaging individual articles of any kind, to be removed once and for all from the package, the same does not necessarily apply to packaging groups of articles to be removed one by one or in small numbers.

Between two uses all that is needed is a minor incident such as an unfortunate shaking or untimely impact, for example, for certain at least of the articles still in place in the body of the package to escape from it, with the risk that they might be irretrievably lost. In this case, consideration might be given to opening the package only partially so that the peel-off film still covers at least part of the open side of the body of the package, so retaining its contents.

The package described in the aforementioned French Pat. No. 1 580 772 can, strictly speaking, lend itself to such partial opening.

However, apart from the fact that they are not provided for this purpose, the tabs on its peel-off film in practice project beyond the contour of the rim of the body, with the costly consequence of making it necessary to use peel-off films of different size to the body.

At present, failing such projecting tabs, the partial opening of a package of the kind in question can only be achieved more or less clumsily, inevitably to the detriment of its efficacy.

Furthermore, projecting from the surface of the package, the portion of the peel-off film already detached from the body of the package may counteract the required result by itself giving rise to the application of an unfortunate shaking or untimely impact to the package, should it interfere with the path of movement of an operator or moving object.

A general objective of the present invention is an arrangement enabling these disadvantages to be alleviated and conferring further advantages.

SUMMARY OF THE INVENTION

The present invention consists of a package comprising a boat-shaped body having one open side, an outwardly projecting rim on said open side, a peel-off film closing said open side and attached to said rim, and at least one reference mark in said rim and said film whereby said package may be partially opened.

For example, this reference mark may be a notch cut into the edge of the rim on the body and into the peel-off film which closes it.

When traction is applied to the peel-off film without special precautions, it may be totally removed in the usual way if required.

However, by virtue of the reference mark in accordance with the invention it is possible to stop tearing off the film at the reference mark and to remove it by tearing off the portion detached in this way from the body of the package.

If desired, the notch constituting the reference mark in accordance with the invention may in this case be made sufficiently deep for such partial removal of the peel-off film to occur systematically on opening the package.

Be this as it may, in all cases the remaining portion of the peel-off film advantageously ensures partial closing off of the body of the package, whilst leaving unrestricted access to its contents.

The risk of all or part of the contents escaping from the package is thus minimized or even eliminated.

This is particularly so in the situation to which the present invention is particularly directed, where the contents consist of elongate articles such as binding ties.

In this case the remaining portion of the peel-off film, which preferably still forms a significant fraction and even more than half of it, efficaciously opposes any fortuitous loss of such articles, by virtue of the fact that it still covers a significant portion of their length.

Furthermore, in all cases the part of the peel-off film detached from the body of the package is advantageously removed.

Apart from the fact that such removal is favorable aesthetically, it avoids any operator or moving object subjecting the package to any shaking or impact through interference with the thus detached part of the peel-off film.

It is already known from the aforementioned French Pat. No. 1 580 772 to provide a reference mark, in this instance a notch, adapted to provide for partial opening of a package by constituting a starting point for tearing of the peel-off film closing it.

However, provided for another purpose and implemented in another embodiment, the reference mark in accordance with the invention yields another result.

The reference mark in accordance with the invention is not provided to facilitate opening of the package concerned, since this is achieved elsewhere, by means of a corner or tab of the peel-off film to be detached, deliberately left free.

It is not provided in the peel-off film only, but also in the rim of the body of the package that it closes.

Also, its result is not to provide systematically wide open access to the contents of the package but, on the contrary, to provide, either as desired or systematically, only limited opening of a package of this kind, at least initially.

Be this as it may, the reference mark in accordance with the invention has the advantage of not entailing any additional cost in respect of the packaging on which it is used.

To the contrary, affecting both the peel-off film and rim of the package body, it is favorable to the implementation of a continuous fabrication process of the combination which is particularly economical and in which there is obtained a continuous string of package bodies, these package bodies are filled as they proceed, a continuous strip is applied to them to form the peel-off film to close them and, by virtue of a single operation applied simultaneously to the package bodies thus closed and filled and the peel-off film closing the body, in motion, a cutting operation when the reference marks are notches, so that the reference marks are formed in the packages before, after or simultaneously with the separation thereof.

The characteristics and advantages of the invention will emerge from the following description given by way of example with reference to the accompanying schematic drawings.

BRIEF DESCRIPTION OF THE DRAWINGS

FIG. 1 is a perspective view of a package in accordance with the invention, shown closed.

FIGS. 2 and 3 are perspective views analagous to that of FIG. 1 and relating to respective modes of opening the package in accordance with the invention, one fully and the other to a limited extent.

FIG. 4 is a view in perspective also analagous to that of FIG. 1 showing the limited opening of the package in accordance with the invention.

FIGS. 5 through 7 are partial views in perspective each corresponding to part of FIG. 1 and relating to respective embodiments of the invention.

DESCRIPTION OF THE PREFERRED EMBODIMENT

The figures show by way of example the application of the invention to bulk packaging of elongate articles, more precisely binding ties 10.

As is known, a binding tie of this kind consists generally of a buckle 11 and, in one piece with this, a strip or thong 12 adapted to be looped back on itself by inserting its end into a passage provided for this purpose in the buckle 11.

The package 13 provided for packaging a group or bundle of such binding ties 10 comprises, in the case under consideration, a boat-shaped body 14 which has an outwardly projecting rim 15 on its open side substantially parallel to its bottom, and for closing the body 14, a peel-off film 16 attached to the rim 15, in practice by its edge.

As in what are usually called blister packs, the body 14 may for example be of a translucent synthetic material, more specifically a transparent synthetic material.

It goes without saying that it may instead be of aluminum, cardboard or any other opaque material, however.

In the embodiment shown, the contour of the open side of the body 14 is generally polygonal.

More precisely, in the embodiment shown it is generally trapezoidal, with rounded corners, to allow for the fact that the binding ties 10 are wider at the end of the buckle 11 than at the end of the strip or thong 12 and the fact that it is simpler and more convenient for all the binding ties 10 to be disposed in the same orientation.

The contour of the rim 15 of the body 14 is generally rectangular in the embodiment shown, however.

In practice, the same goes for the contour of the peel-off film 16, this reflecting that of the rim 15 of the body 14.

Like the body 14, the peel-off film 16 may be in a translucent, more specifically transparent synthetic material.

It goes without saying that it may instead be of aluminum or any other opaque material or combination of materials, however.

Be this as it may, it preferably extends integrally over the contour of the rim 15 of the body 14, as shown here, and it is attached in a removable manner to the rim 15 at its edge, as by welding or by means of an adhesive, for example; one or more of its corners 17 does not adhere to the rim 15, in order to constitute gripping tabs by means of which the traction needed to pull it off may be applied.

These arrangements are well known in themselves and as they do not of themselves form part of the present invention they will not be described in more detail here.

For the purpose of possible partial opening of the body 14 of the package 13 thus constituted, the invention provides at least one localized reference mark 19 which affects both the rim 15 of the body 14 and the peel-off film 16 closing it.

In practice at least one reference mark 19 is provided in this way on each of two opposite sides of the corner of the rim 15 of the body 14, in corresponding relationship with one another from one of these sides to the other, and spaced from both ends of these sides.

In the embodiment shown, there are thus provided two spaced reference marks 19 on each of the two longer sides of the contour of the rim 15 of the body 14.

In practice, these reference marks 19 are each disposed one third of the way along the length of the side of the contour of the rim 15 of the body 14 concerned.

In the embodiment shown, each of the reference marks 19 employed is a V-shaped notch cut into the rim 15 of the body 14 from its edge, this edge cutting in a complementary way at 19' into the corresponding edge of the peel-off film 16 closing the body 14.

The package 13 in accordance with the invention may be opened in either of the following two ways.

When it is required to completely open the body 14 of the package 13, it is sufficient in the usual way to hold the body 14 in one hand, without the thumb touching the rim 15, and to pull on the peel-off film 16 with the other hand, gripping it for this purpose by one of the corners 17 left unattached for this purpose, as shown in FIG. 2.

In the manner known in itself, there then occurs what might be called an unrolling of the peel-off film 16 as it is progressively detached from the rim 15 of the body 14.

When, on the other hand, only partial opening of the body 14 is required, it is sufficient to stop such unrolling in line with a reference mark 19, for example by applying the thumb to the rim 15 of the body 14 at this point, as schematically represented in FIG. 3.

The peel-off film 16 is then systematically torn off in line with the reference mark 19 concerned, resulting in total removal of the corresponding portion of the peel-off film 16, the tear line then running from the reference mark 19 concerned on the relevant side of the rim 15 of the body 14 to the opposite side of this contour, ending in practice and as shown here at the corresponding reference mark 19 thereon.

As shown in FIG. 4, the body 14 of the package 13 in accordance with the invention is then partially closed by the remaining portion of the peel-off film 16.

It is to be understood that if required this remaining portion may be removed either by pulling on its inside surface by inserting the hand through the previously obtained opening in the body 14 or by starting from one of the remaining corners of the peel-off film 16, as previously.

Likewise, if desired, the peel-off film 16 may be partially removed at both ends, so that only a strip remains in the median part of the body 14.

In all cases the initial opening may be done from either end of the peel-off film 16, whether the opening is to be complete or only partial, by virtue of a greater or lesser open area of the body 14 concerned.

In the embodiment shown in FIG. 5, the notch 19, 19' has a rectangular contour instead of a V-shape.

It goes without saying that it may have any shape contour, however; it may be semi-circular for example.

Also, the reference mark in accordance with the invention is not necessarily formed by a notch.

For example (FIG. 6) it may be merely a slit with contiguous edges 29, 29' obtained by cutting.

Alternatively (FIG. 7) it may consist of a simple deformation 39, 39' affecting both the rim 15 of the body 14 and the peel-off film 16, of V-shape for example.

The present invention is not limited to the embodiments described and shown but encompasses any variant execution.

Specifically, the notches or slits which preferably constitute the reference marks in accordance with the invention may be sufficiently accentuated for the peel-off film to be systematically torn at their location on opening the package.

Also, any number of reference marks may be used in this way on at least one side of the package concerned; this number may be greater than two, for example, to provide enhanced possibility of partial opening in several stages, for example.

Application of the invention is not limited to the packaging of binding ties, or even to the packaging of elongate articles of this type, but naturally extends to the packaging of any other articles including, if required, hermetically sealed, vacuum and protective atmosphere packaging.

We claim:

1. Package containing elongate articles extending generally parallel to each other, said package comprising a trough-like body having one open side, an outwardly projecting peripheral rim on said open side, a peel-off film closing said open side and being attached to said rim, and at least one reference mark in said rim and said film, said articles having a length dimension, said reference marks defining means for facilitating peeling-off of a part only of said film generally transversely to the length of articles leaving a remaining part of said film adhered to said rim, said remaining part of said film constituting means for retaining articles in the partially opened package.

2. Package according to claim 1, wherein said reference mark is a notch in the edge of said rim.

3. Package according to claim 2, wherein said notch is V-shaped.

4. Package according to claim 1, wherein said reference mark is a slit the edges of which are contiguous.

5. Package according to claim 1, wherein said reference mark is a deformation.

6. Package according to claim 1, wherein said rim is generally rectangular in outline and has short and longer sides, and said reference marks are in one of said longer sides.

7. Package according to claim 1, wherein said rim is generally rectangular in outline and has two opposite sides, and there is at least one said reference mark on each of said two opposite sides of said rim aligned with each other transversely of the articles and spaced from the ends of said opposite sides.

8. Package according to claim 7, comprising at least two of said reference marks in each of said opposite sides, spaced from one another.

9. Package according to claim 8, wherein said two reference marks in each of said opposite sides divide said opposite sides into three portions of substantially the same length.

10. Package according to claim 1, wherein said film covers all of the contour of said rim.

11. Package comprising a trough-like body having one open side, an outwardly projecting peripheral rim on said open side, a peel-off film closing said open side and attached to said rim, and identical tear-start zones in said rim and said film in contiguous overlying relation for peeling-off part of the film, said rim being generally rectangular in outline and having two opposite sides, and there being tear-start zones on each of said two opposite sides of said rim aligned with each other and spaced from ends of said opposite sides.

12. Package according to claim 11, wherein said tear-start zones comprise notches in the edge of said rim and said film.

13. Package according to claim 12, wherein said notches are V-shaped.

14. Package according to claim 11, wherein said tear-start zones are slits in the edge of said rim and said film.

15. Package according to claim 11, wherein said tear-start zones are deformations in the edge of said rim and said film.

16. Package according to claim 11, wherein said rim is generally rectangular in outline and has short and longer sides, and said tear-start zones are disposed on one of said longer sides.

17. Package according to claim 11, comprising at least two tear-start zones in each of said sides, said tear-start zones in each of said sides being spaced from one another.

18. Package according to claim 17, wherein said tear-start zones divide each of said opposite sides into three portions of substantially the same length.

19. Package according to claim 11, wherein said film and said rim each has a free edge, and the free edge of said film and the free edge of said rim are contiguous.

* * * * *